US011317686B2

(12) United States Patent
Vouillamoz et al.

(10) Patent No.: US 11,317,686 B2
(45) Date of Patent: May 3, 2022

(54) WEARABLE CONSTRUCT WITH DYNAMIC FLUID DISPLAY

(71) Applicant: Preciflex SA, Neuchâtel (CH)

(72) Inventors: Lucien Vouillamoz, Feusisberg (CH); Antoine Sandoz, London (GB); Gregory Dourde, Neuchâtel (CH); Federica Carpano, La Chaux-de-Fonds (CH)

( * ) Notice: Subject to any disclaimer, the term of this patent is extended or adjusted under 35 U.S.C. 154(b) by 0 days.

(21) Appl. No.: 15/766,376

(22) PCT Filed: Oct. 6, 2016

(86) PCT No.: PCT/IB2016/001448
§ 371 (c)(1),
(2) Date: Apr. 6, 2018

(87) PCT Pub. No.: WO2017/060767
PCT Pub. Date: Apr. 13, 2017

(65) Prior Publication Data

US 2018/0295953 A1 Oct. 18, 2018

Related U.S. Application Data

(60) Provisional application No. 62/237,896, filed on Oct. 6, 2015, provisional application No. 62/396,833, filed on Sep. 20, 2016.

(51) Int. Cl.
*A44C 25/00* (2006.01)
*A44C 5/00* (2006.01)
(Continued)

(52) U.S. Cl.
CPC ..... *A44C 25/002* (2013.01); *A44C 5/0007* (2013.01); *A44C 9/00* (2013.01);
(Continued)

(58) Field of Classification Search
CPC ..... A44C 25/002; A44C 5/0007; A44C 9/00; A44C 15/00; A44C 15/005; A44C 7/00; G04B 47/044
See application file for complete search history.

(56) References Cited

U.S. PATENT DOCUMENTS 1,421,329 A * 6/1922 Welch ..... A44C 17/007 63/38
1,730,257 A * 10/1929 Welch ..... A44C 17/007 63/32
(Continued)

FOREIGN PATENT DOCUMENTS

WO WO2011/021098 A1 2/2011

OTHER PUBLICATIONS

International Search Report, International patent application No. PCT/IB2016/001448, dated Jan. 24, 2017.

*Primary Examiner* — Jack W Lavinder
(74) *Attorney, Agent, or Firm* — Da Vinci Partners LLC; John Moetteli

(57) ABSTRACT

A construct (10) is provided having an aesthetic form adapted to please a wearer and to be worn by the wearer. The construct provides a structure on which functional elements are integrated. The functional elements include several elements. A first element is a fluid reservoir. A second element is at least two fluids (12, 14) disposed in the fluid reservoir. A third element is a motion generator (22) having a state in equilibrium with respect to an attraction force and a further attraction or repulsion force when the construct is at rest, the motion generator causing an animation effect when the construct is moved relative to an attraction or repulsion force.

26 Claims, 16 Drawing Sheets

(51) Int. Cl.

| | |
|---|---|
| ***A44C 9/00*** | (2006.01) |
| ***A44C 15/00*** | (2006.01) |
| ***G04B 47/04*** | (2006.01) |
| *A44C 7/00* | (2006.01) |

(52) U.S. Cl.
CPC ..... *A44C 15/00* (2013.01); *A44C 15/005* (2013.01); *G04B 47/044* (2013.01); *A44C 7/00* (2013.01)

(56) References Cited

U.S. PATENT DOCUMENTS

| | | | | | |
|---|---|---|---|---|---|
| 1,850,190 | A * | 3/1932 | Welch | A44C 17/007 | 63/32 |
| 1,912,602 | A * | 6/1933 | Stonberg | A44C 17/00 | 63/32 |
| 3,486,109 | A | 12/1969 | Eberhardt | | |
| 4,034,554 | A | 7/1977 | Hadany | | |
| 4,196,899 | A * | 4/1980 | Patterson | G09F 13/24 | 273/161 |
| 5,077,709 | A * | 12/1991 | Feher | G04B 47/044 | 368/229 |
| 5,272,681 | A * | 12/1993 | Lee | G04B 45/046 | 368/223 |
| 2007/0234757 | A1 * | 10/2007 | Sherman | A44C 25/002 | 63/18 |
| 2012/0103015 | A1 * | 5/2012 | Graham | A44C 9/0061 | 63/15 |

* cited by examiner

WEARABLE CONSTRUCT WITH DYNAMIC FLUID DISPLAY

CROSS REFERENCE TO RELATED APPLICATIONS

This application is the National Stage of International Application No. PCT/IB2016/001448, filed Oct. 6, 2016, which claims benefit under 35 USC § 119(a), to U.S. provisional patent application Ser. No. 62/237,896, filed Oct. 6, 2015, and to U.S. provisional patent application Ser. No. 62/396,833, filed Sep. 20, 2016.

COPYRIGHT & LEGAL NOTICE

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever. Further, no reference to third party patents or articles made herein is to be construed as an admission that the present invention is not entitled to antedate such material by virtue of prior invention.

FIELD OF THE INVENTION

The invention relates to methods and devices for the industrial and artistically manufacturing of jewelries comprising at least one encapsulated fluid as an esthetical feature.

BACKGROUND OF THE INVENTION

In the field of jewelry, fluids are known in the art as an auxiliary esthetical element. The fluids may be colored or without color, may contain floating or non-floating particles. The fluids may be of gas or liquid, and where there are more than one liquid, these liquids may be immiscible.

SUMMARY OF THE INVENTION

This invention relates to methods and devices for the industrial and artistically manufacturing of jewelries comprising encapsulated fluids. These fluids, or part of the fluids are visible to an observer and serve as esthetical element, may be colored or without color, may contain floating/non-floating particles or particles in suspension, and so may be animated in some way. The fluids may be of gas or liquid, and where there are more than one fluid, these fluids may be immiscible. The fluid(s) and/or the optionally contained particles shall be influenced through a controlled utilization of external occurring influencing factors. The at least one chamber containing fluid(s) are arranged and incorporated into a piece of jewelry in a manner to benefit from external parameters like temperature/temperature changes, gravity vectors/vector changes, electrical force vectors/vector changes, magnetic force vectors/vector changes, thermal/infrared radiation emanate by light/sunlight, or atmospheric pressure/pressure changes in order to animate the fluid(s) and/or the particles contained in the chamber(s).

The construct is wearable, fluid filled, and typically constructed of glass, crystal or precious or semi-precious stones, affixed in an impermeable (watertight) manner to a base.

The fluids are animated by the combined use of gravity, and/or magnetism, and/or the surface tensions of liquids, and/or the surface tensions of substrates, and/or magnetic and/or electrostatic and/or gravitational agitators in suspension in the fluids, in order to create decorative effects and/or dynamic animations. To create fluidic dynamic decorative animations in jewels, encapsulated fluids are set in motion by the individual or combined use of gravity, magnetism, fluid type or substrates, surface tension or suspended stirrers sensitive to magnetic, electrostatic or gravitational forces.

In one embodiment, the invention includes an integrated network of canals interconnected in a manner such that the liquid and/or gas may circulate within the network of canals. To facilitate movement of the fluid in the canal, the reservoir surfaces are treated so as to repel the liquid, such that the liquid in the cavity acts as a mass and does not stick to the surfaces. An example visual effect easily envisioned by the reader would be liquid mercury whose surface tension is so high that it balls up and moves readily in a channel with essentially no friction. Clearly, liquid mercury has a high mass compared to other liquids, but it is considered hazardous and is not possible to color. Consequently, other liquids are preferably selected that are not hazardous. It is important then that the surfaces of the reservoir be treated so that considering the mass and weight of the liquids chosen, the fluid can still act like liquid mercury. This generally means that the gravitational force on the liquid chosen should readily overcome any attraction force to the surface in the reservoir, thus permitting ease of circulation of the fluids within the reservoir.

The filling of the fluid reservoirs with a fluid or fluids is performed during assembly when the reservoirs are open, and then closed after introduction of the fluids. The fluid reservoirs may also be created by sandwiching of two or more pre-formed layers together in a laminate in which at least one of the layers is transparent.

Fluids in motion by an external force applied on the jewel should be mentioned. The energy is generated for instance by pressing a mobile part of the jewel and/or by pulling a part (like a cord or a slide) of the jewel and/or by rotating a part of the jewel. The energy is transferred to an internal mechanical stocking system (as of a barrel or a bellow). The stocked energy put the fluids in motion either fast or slowly, depending on the energy transfer system from the stoking system to the chamber. When the energy is entirely transferred, fluids can either come back to their original position either stay in a new equilibrium position.

To amplify the effect of animation, different hydrophobic, hydrophilic or oleophonic, oleophilic surface treatments are applied.

Said jewelries feature at least one chamber to encapsulate one or more fluids. The chambers are at least partially transparent and the at least one encapsulated fluid is through the transparent part visible to an observer. The fluids may have freedom to move within a chamber, in particular if a chamber contains more than one fluid. The optionally contained particles may be free to move either within one fluid and being limited to cross a barrier layer between different fluids, or may be free to cross such a barrier layer.

The embodiments of said jewelries might be realized as rings, charms, necklaces, pendants, earrings, bracelets or may be incorporated in watches, wrist watches, glasses or other devices. Devices that can be used for decorating others accessories like shoes, bags, belts, suspenders, hats should be mentioned.

The chamber(s) containing the fluid(s) are made out of glass, crystal glass, cut glass, crystal (or suitable substitute material) jewel, precious stones or half-precious stones and fixed on to a precious or non-precious metal. Part of the chamber may be realized in metal or a flexible material.

The (thermal) expansion of the fluid(s) is managed and compensated according to the invention disclosed in the patent applications PCT/IB2016/000448, filed on Apr. 7, 2016, PCT/IB2016/000004, filed on Jan. 7, 2016, PCT/IB2015/001611, filed on Sep. 11, 2015, PCT/IB2015/001336, filed on Aug. 6, 2014, PCT/IB2015/000446, filed on Apr. 3, 2014. PCT/IB2015/000448, filed on Apr. 3, 2014, the content of which is incorporated by reference and relied upon to define the invention claimed herein.

The replenishment of the chamber(s) is performed though one or more openings which are tightly closed after the replenishment or during the assembling process.

SUMMARY OF THE INVENTION

A construct is provided having an aesthetic form adapted to please a wearer and to be worn by the wearer. The construct provides a structure on which functional elements are integrated. The functional elements include several elements. A first element is a fluid reservoir. A second element is at least two fluids disposed in the fluid reservoir. A third element is a motion generator having a state in equilibrium with respect to an attraction force and a further attraction or repulsion force when the construct is at rest, the motion generator causing an animation effect when the construct is moved relative to an attraction or repulsion force.

The fluids, or part of the fluids are visible to an observer and serve as esthetical element, may be colored or without color (and even appear to change color), may contain floating/non-floating particles or particles in suspension. The fluids may be of gas or liquid, and where there are more than one liquid, these liquids may be immiscible. The chamber containing fluid(s) are arranged and incorporated into a piece of jewelry in a manner to benefit from external parameters like temperature/temperature changes, gravity vectors/vector changes, electrical force vectors/vector changes, magnetic force vectors/vector changes, thermal/infrared radiation emanate by light/sunlight, or atmospheric pressure/pressure changes.

Figure 1A:
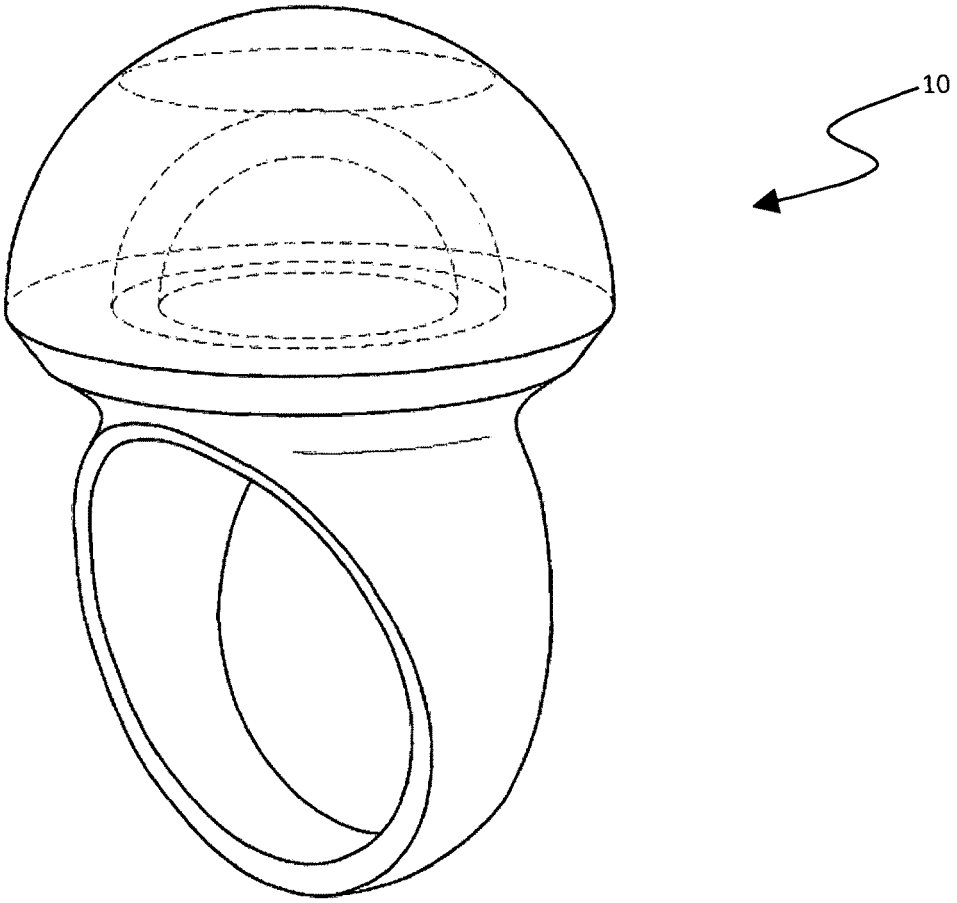
FIG. 1A is a perspective view of the first embodiment.

Those skilled in the art will appreciate that elements in the figures are illustrated for simplicity and clarity and have not necessarily been drawn to scale. For example, dimensions may be exaggerated relative to other elements to help improve understanding of the invention and its embodiments. Furthermore, when the terms 'first', 'second', and the like are used herein, their use is intended for distinguishing between similar elements and not necessarily for describing a sequential or chronological order. Moreover, relative terms like 'front', 'back', 'top' and 'bottom', and the like in the description and/or in the claims are not necessarily used for describing exclusive relative position. Those skilled in the art will therefore understand that such terms may be interchangeable with other terms, and that the embodiments described herein are capable of operating in other orientations than those explicitly illustrated or otherwise described.

DETAILED DESCRIPTION OF THE PREFERRED EMBODIMENT(S)

The following description is not intended to limit the scope of the invention in any way as they are exemplary in nature and serve to describe the best mode of the invention known to the inventors as of the filing date hereof. Consequently, changes may be made in the arrangement and/or function of any of the elements described in the disclosed exemplary embodiments without departing from the spirit and scope of the invention.

An inventive construct is provided having an aesthetic form adapted to please a wearer and to be worn by the wearer. The construct provides a structure on which functional elements are integrated. The functional elements include several elements. A first element is a fluid reservoir. A second element is at least two fluids disposed in the fluid reservoir. A third element is a motion generator having a state in equilibrium with respect to an attraction force and a further attraction or repulsion force when the construct is at rest, the motion generator causing an animation effect when the construct is moved relative to an attraction or repulsion force.

One of the attraction or repulsion forces is gravity, which causes a separation between fluids of differing specific weights. The further attraction or repulsion force is provided by a magnetic material such as a magnetic fluid or a permanent magnet or magnetic particulate suspended in a fluid.

A motion generator is provided in the construct which is at least mass-wise eccentric to an axis of motion such as rotation so that motion of the user moves the motion generator which in turn directly interacts with at least one of the at least two fluids in the fluid reservoir, thereby creating an animated movement of the fluids.

Surface tension in a fluid reservoir is induced by coatings, such surface tension determining the form and movement of the fluid or fluids.

A coating on magnetic agitators induces surface tension on the fluid or fluids.

A particulate is optionally suspended in at least one of the fluids.

Surface tension of surfaces of particulate suspended in the fluid or fluids affects an interface surface between the fluids. At least two encapsulated fluids are immiscible. Both the fluids can be liquids but one may be a gas.

Preferably, at least two fluids are of different colors or refraction indexes so that one fluid is readily visually discernable from the other.

Solid or particulate decorative elements are suspended in at least one fluid.

The reservoir may be a maze and the fluids are guided within the maze by a mass, directly or indirectly guided by a magnet. The mass may be the mass of a liquid enclosed in the fluid reservoir. Alternatively, the mass may be a magnet, or a magnetic liquid. Typically, the motion generator comprises at least one magnet.

Optionally, at least one magnet is attached to a buoy device which causes the at least one magnet to float in the at least one fluid.

The construct may incorporate a mechanism adapted to indicate the passing of time or show changes in temperature. Of course, the construct can be a piece of jewelry such as a ring or a bracelet or necklace, even a decorative body piercing element.

The fluid reservoir of the construct may be formed of a network of channels defined by channel surfaces. The channels may be interconnected in a manner such that the liquid and/or gas may circulate within the network of channels. To facilitate movement of the liquid in the channel, the channel surfaces are treated so as to repel the liquid, such that the liquid in the reservoir acts as a mass and essentially does not stick to the channel surfaces.

One of the liquids can be a liquid metal such as mercury.

The surfaces of the reservoir are treated to have a surface tension such that considering the mass and weight of liquid or liquids selected for introduction into the fluid reservoir, and consequently the gravitational force on such chosen liquid or liquids, the gravitational force on the chosen liquid or liquids readily overcomes any attraction force to the surface in the reservoir, thus permitting ease of circulation of the chosen liquid or liquids within the reservoir. A magnet further facilitates movement by acting on magnetic elements in the construct.

Figure 1B:
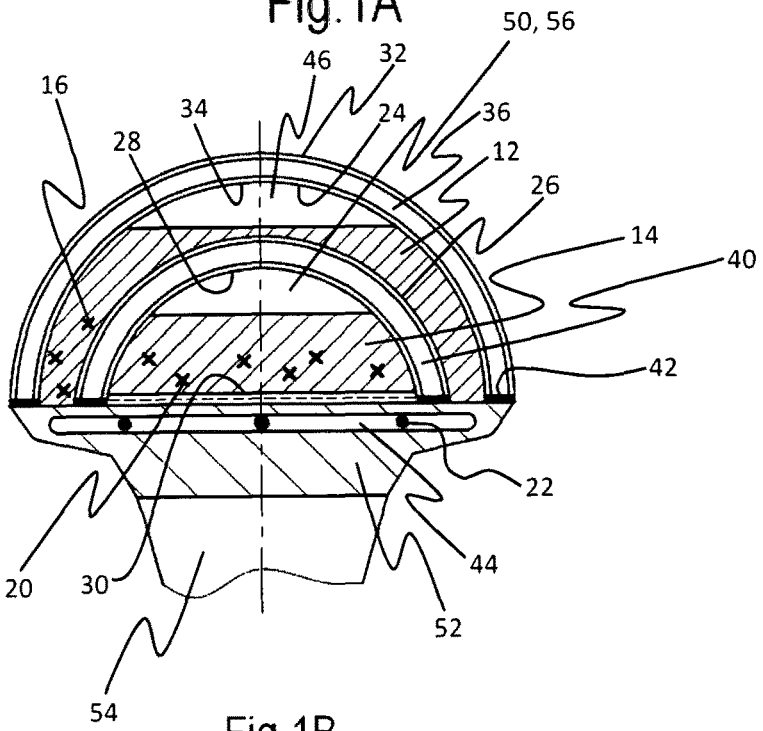
FIG. 1B is a cross-sectional view of the first embodiment.

Referring now to FIGS. 1A and 1B, a ring 10 is shown with liquids 12, 14 animated by particles 16, 20, themselves animated by magnets 22, the animation being facilitated by repellent surface treatments 24, 26, 28, 30 allowing said liquids to move more easily. An exterior coating 32 is provided for protection and for contributing to the optical effects. An oleophobic/hydrophobic coating 24 is provided on the interior surface 34 of a first treatment half sphere 36. The exterior and interior transparent half-spheres 36, 40 are made of, for example, glass or crystal. The half-spheres 36, 40 are mounted to the base of the ring via a glass-to-metal adhesive 42. Optionally, an empty chamber 44 is disposed underneath the spheres 36, 40, inside which are placed one or more micro-magnets 22, which move about freely as the wearer moves. In one embodiment, the chamber is made up several chambers, each containing a magnet 22. The magnets 22 are optionally micro-magnets. Optionally, particles in suspension 16 are added to one or more of the filling liquids, some of the particles being magnetized to a certain extent. A liquid 12 that partially fills an outer chamber 46 between the half-spheres 36, 40 is disposed between the half-spheres. A liquid 14 partially fills the chamber 50 disposed between the half-sphere 40 and the base 52 of the ring 10, which typically includes a hoop 54 of the ring for encircling a wearer's finger. A coating 30 may be applied to the base of the ring. Thus the chamber 50 is filled with a gas or air 56 and the liquid 14. The aesthetical effects are provided either by the superposition of the colors of the liquids moving in each chamber and/or by the displacement of the small particles moved by gravity and/or by the magnetic field created by the magnets in the chamber 44.

Figure 2A:
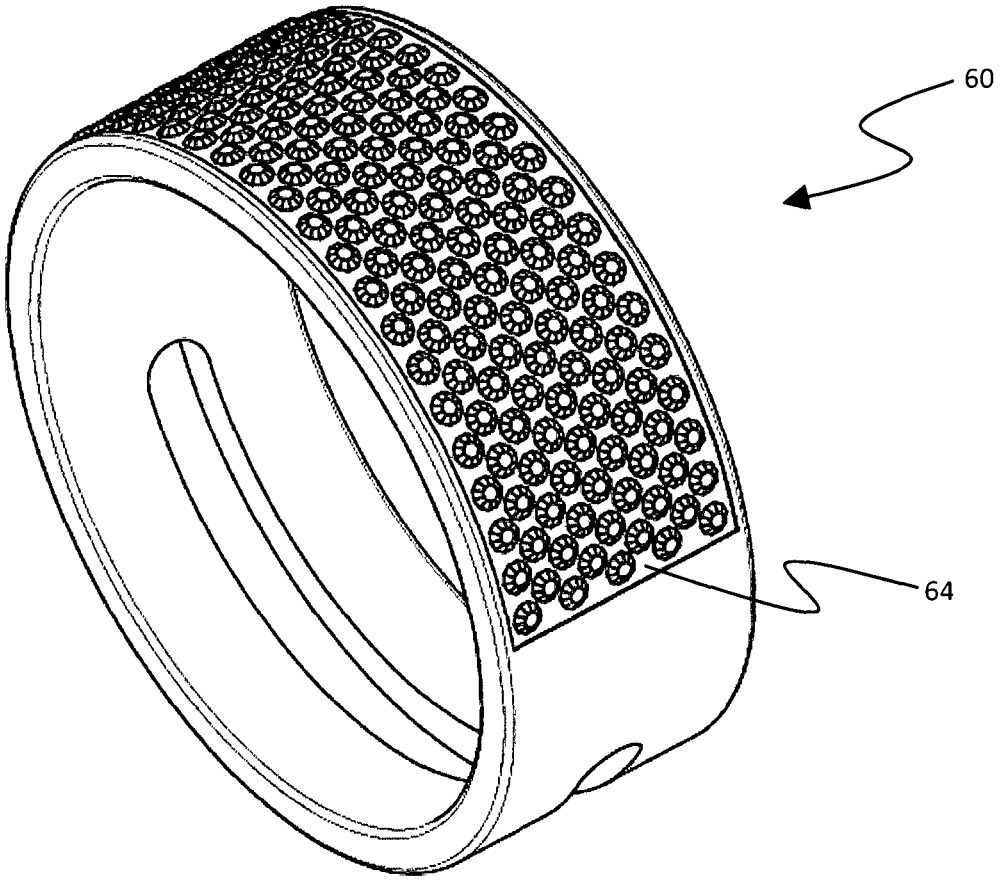
FIG. 2A is a perspective view of the second embodiment.
Figure 2B:
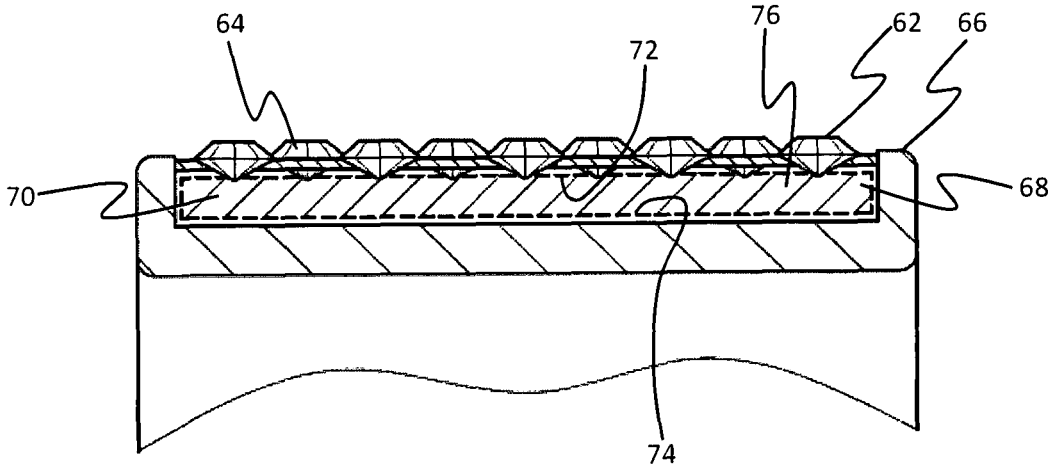
FIG. 2B is a cross-sectional view of the second embodiment.

Referring now to FIGS. 2A and 2B, a bracelet 60 with a setting of precious or semi-precious stones 62 is shown, set in a glass or crystal plate 64, itself bonded to a base 66. One or more fluids 68, 70, one of which may be a gas are contained between this base 66 and this plate 64, with one of the liquids optionally being a ferrofluid. hydrophobic, hydrophilic or oleophobic or oleophilic coatings 72, 74 that repel and/or attract the liquids cause pockets of said liquid 68 or 70 to wet a certain number of stones 62, inside a chamber 76 on the metal base 66 and/or on the glass or crystal 64. The stones 62 may be coated or non-coated. The refraction index of the liquids 68, 70 is chosen so as to dull the luster of the stones 62 which will form a contrast with the stones whose base is in the gas. This will form moving designs in the setting as shown. The stones 62 are impermeably mounted in a watertight manner to the glass or crystal 64.

Figure 3A:
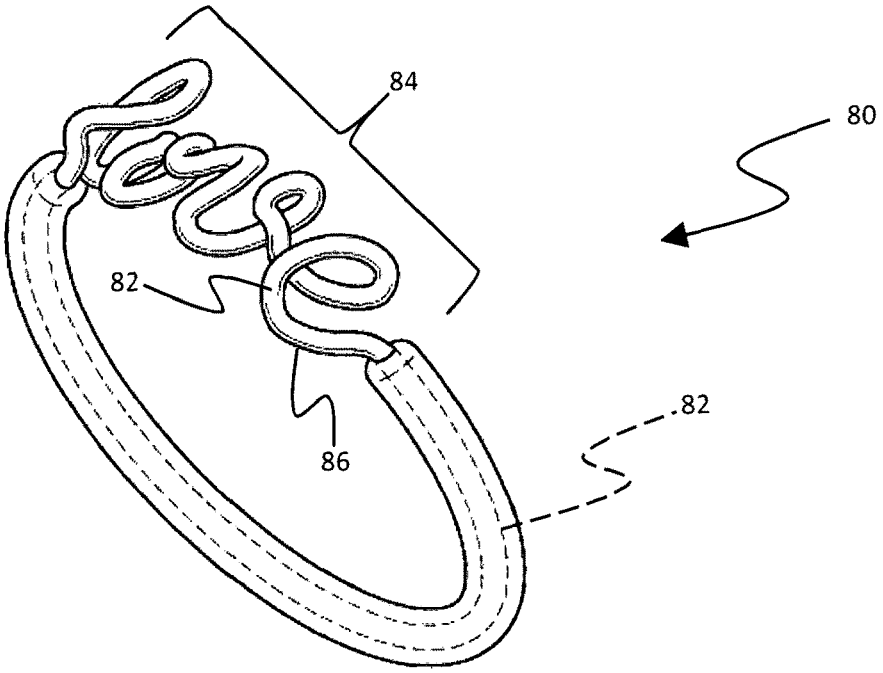
FIG. 3A is a perspective view of the third embodiment.
Figure 3B:
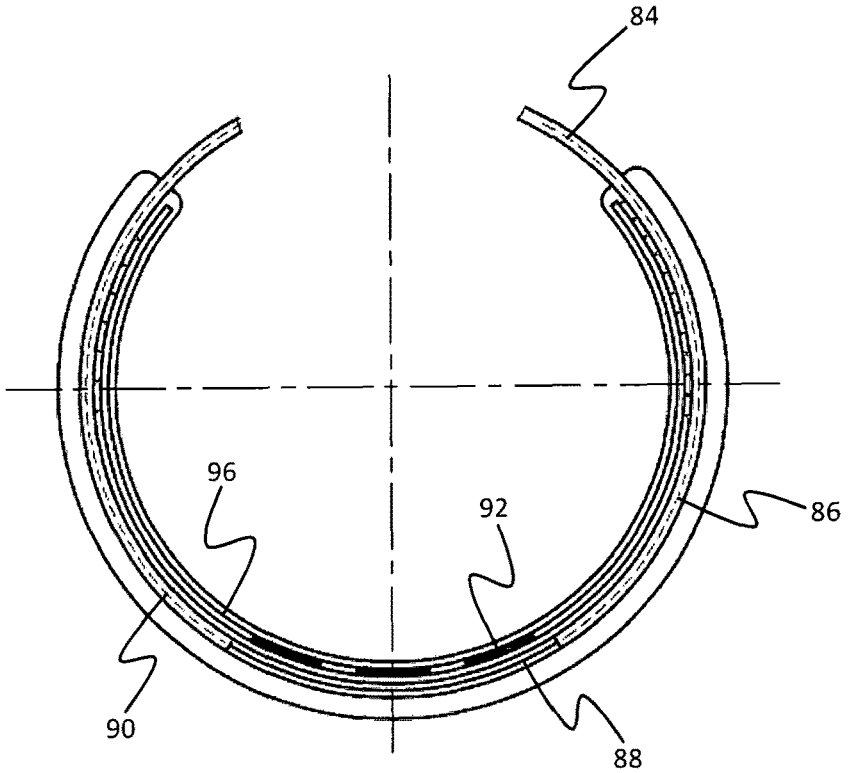
FIG. 3B is a cross-sectional view of the third embodiment.

Referring now to FIGS. 3A and 3B, a ring 80 is shown having a capillary tube 82 exposed in part in a region 84 to reveal to a wearer one artistically formed segment 86. The capillary tube 82 is filled with various fluids 84, 86, 88, 90 that are immiscible with each other, at least one segment of which (liquid 86) is magnetized (a ferrofluid). By means of preferably spherical micro-magnets 92 placed in a channel 96, which is not visible here and is adjacent this capillary tube 82 as shown, the column of fluids 84, 86, 88, and 90 inside the capillary tube is animated. The fluids 84, 86, 88, 90 are arranged so that a colored segment and a colorless segment are visible and move about in the artistically formed area as the wearer moves due to the micro-magnets 92 moving in the channel 96. The purpose of the segments of fluid 84, 86, 88, 90 is to optimize the positioning of the fluid 84 so that even with very small movements of the magnets, we see the meniscus between the fluid 84 and the fluid 86 move in the area where the capillary tube 82 is shaped so as to read "love," or any other decorative text or shape. The ferrofluidic liquid 86, functions as a sort of piston during the movements of the micro-magnets 92. The liquid 88 is a colored liquid which forms a visible and esthetic contrast with the fluid 86.

Figure 4A:
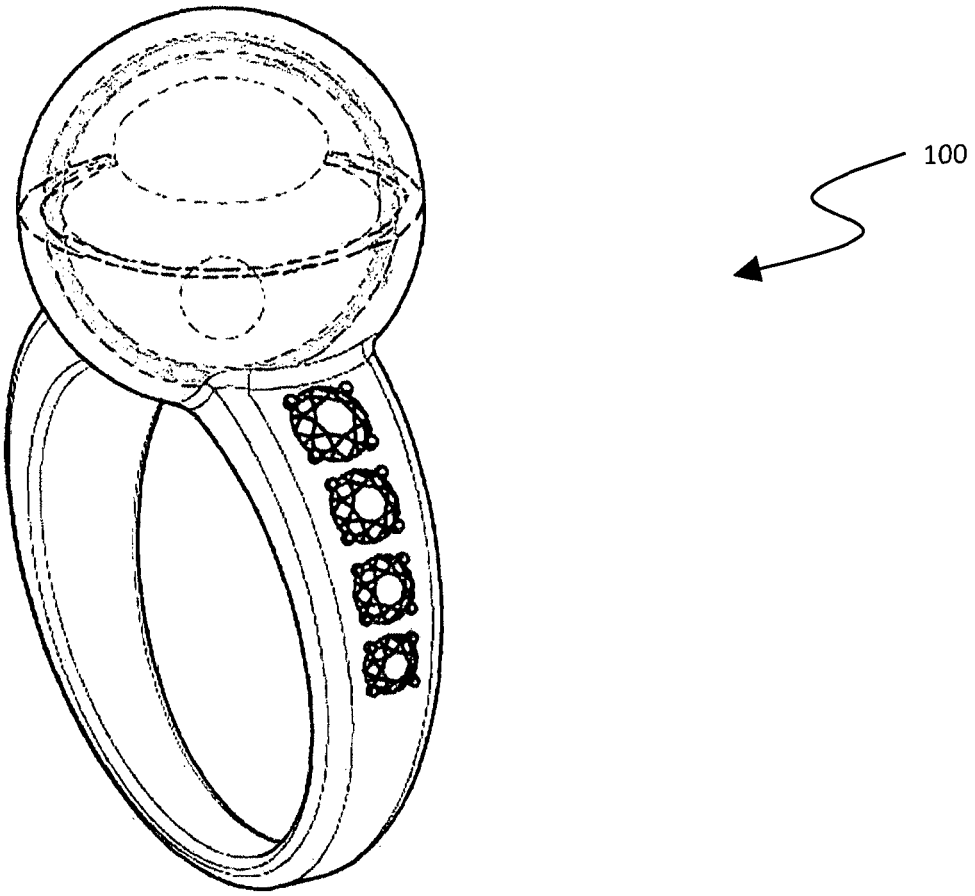
FIG. 4A is a perspective view of the forth embodiment.
Figure 4B:
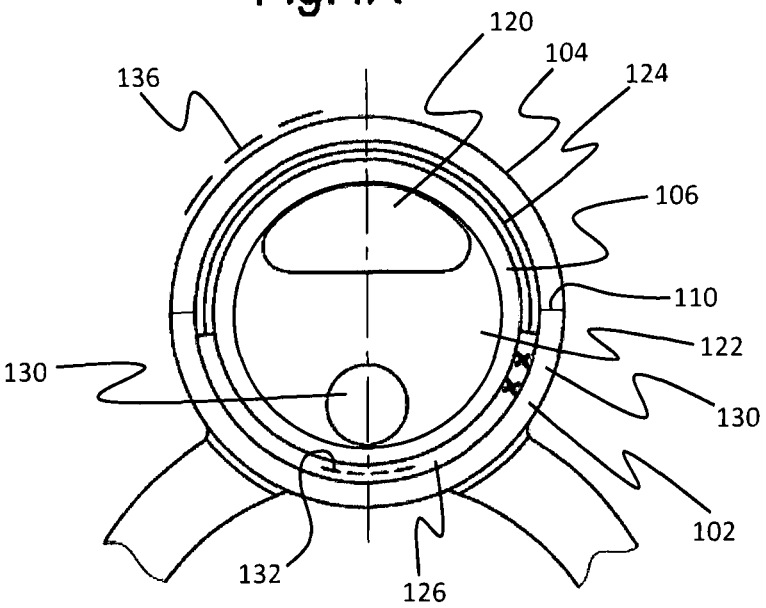
FIG. 4B is a cross-sectional view of the forth embodiment.

Referring now to FIGS. 4A and 4B, a ring 100 with a base 102 on which two concentric spheres 104, 106 is shown. Sphere 104 is made of glass or crystal. The dotted line 110 shows the place where the two halves 112, 114 of the sphere have been joined, for example by fusion bonding. The fusion point 110, once the fusion bonding is complete, will become invisible. The outer sphere 104 is transparent; the inner one 106 is opaque and provided with an empty cavity 120 and a cavity 122 filled with a metal or other heavy material. Between the two spheres 104, 106 are two or more viscous, immiscible fluids 124, 126 which can be charged with particles 130 (the green x's), which can be colored or shiny, precious or nonprecious. The viscosity of the fluids 124, 126 must allow the center ball 106 to glide continuously inside the outer sphere 104. A colored liquid or cavity 120 has a lower density than the transparent fluid 126. Thus essentially a cavity 120 is formed in the pearl or center sphere 106. This chamber 120 should be close enough to the outside of the sphere 104 to allow a certain flexibility of the wall, in order to absorb the expansions of the fluids. This chamber 120 must also accentuate the unbalanced mass of the center sphere 106. The fluid 126 is transparent or of a different color than the fluid 124. A mass 130 may be added to the inside of the pearl or center sphere 106 to guarantee its unbalanced mass. A coating 132 is repellent to two or more fluids 124, 126, in order to optimize the movements of the center sphere. Note that the coating of the center sphere 106 must be repellent to one of the liquids and have an affinity to the other, in order to make its movements visible by pulling the liquid with which it has an affinity along as it moves. Exterior coating 136 is provided for optimizing the optical effects.

Figure 5A:
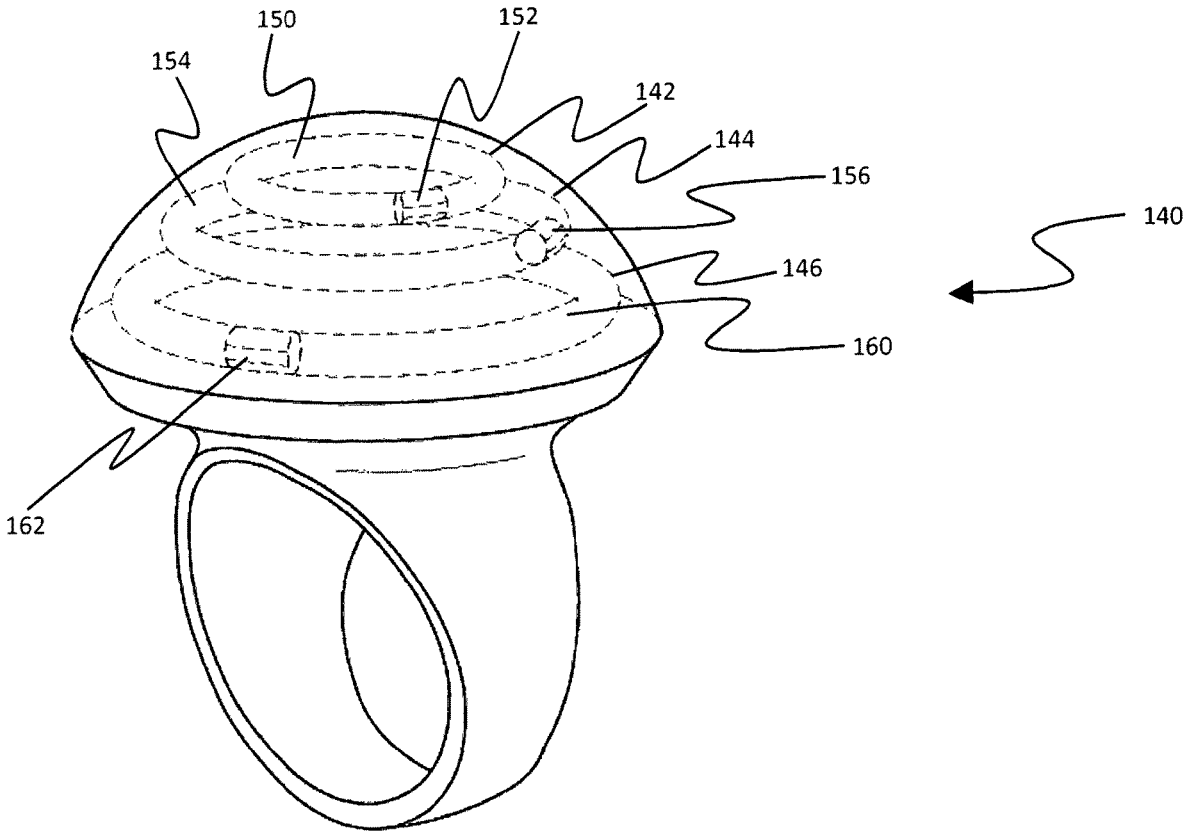
FIG. 5A is a perspective view of the fifth embodiment.
Figure 5B:
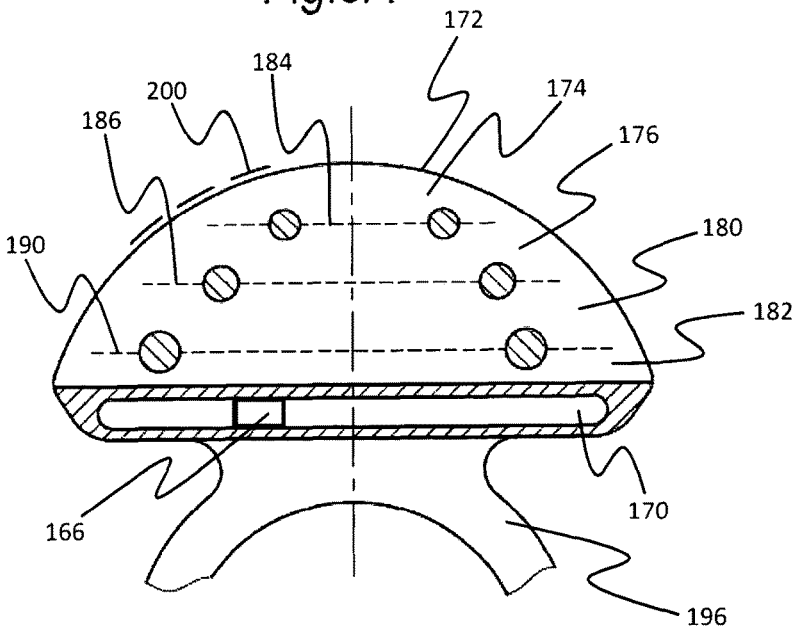
FIG. 5B is a cross-sectional view of the fifth embodiment.

Referring now to FIGS. 5A and 5B, a ring 140 with several channels 142, 144, and 146 is provided in which two or more fluids 150, 152 or 154, 156 or 160, 162 are encapsulated. At least one of the segments of the fluids is charged with magnetic particles. This charged segment moves in tandem with the movements of the magnet or magnets 166 placed in a chamber 170 formed underneath them inside the ring 140. The stone, glass, or crystal assembly 172 cut into several slices 174, 176, 180, 182 (in this case, 4), and one of the several channels 142, 144, 146 is formed between each of the slices. Bonding areas 184, 186, 190 are formed typically by fusion bonding. Channels 142, 144, 146, typically 0.6 mm in diameter, are formed for example by water jet cutting or another method. A fluid segment, for example 152, 156 and/or 162 is charged with magnetic particles. A micro-magnet 166 is free to move about inside the chamber 170, which is provided in the base 196 of the ring 140, inside which one or more micro-magnets 166 move about. An exterior coating 200 is provided for optimizing the optical effects. Interior coating 202 is provided on the channels 142, 144, 146, repellent to both fluids contained therein.

Figure 6A:
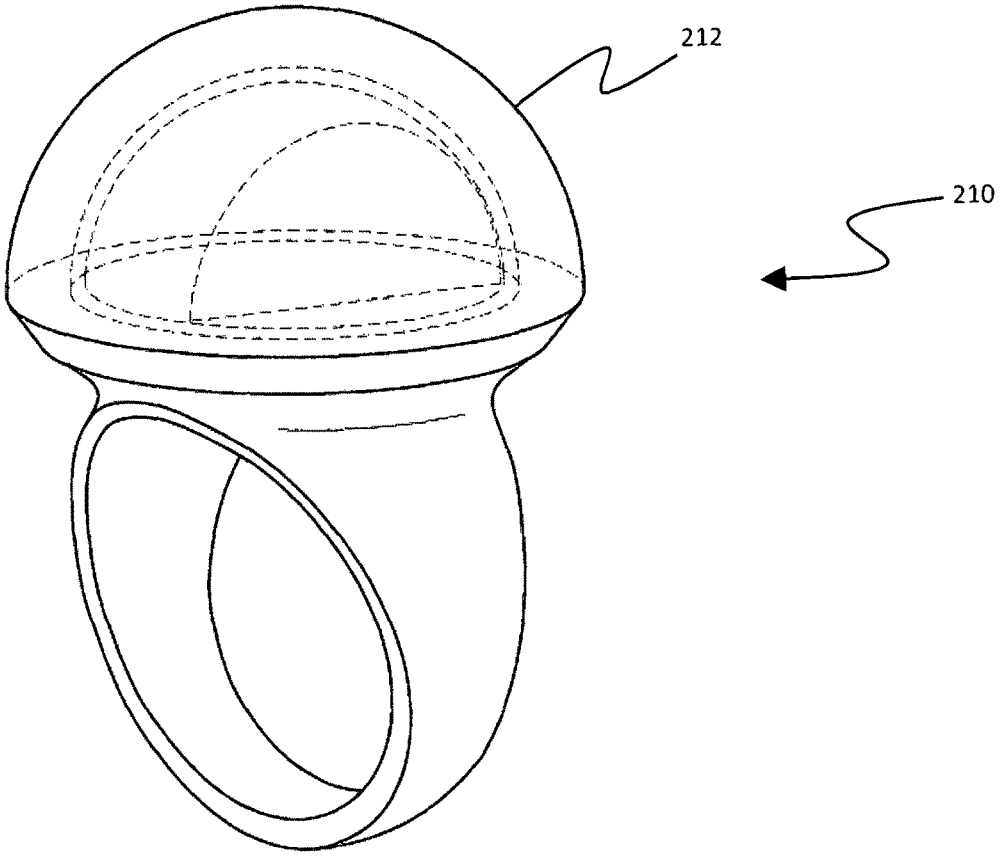
FIG. 6A is a perspective view of the sixth embodiment.
Figure 6B:
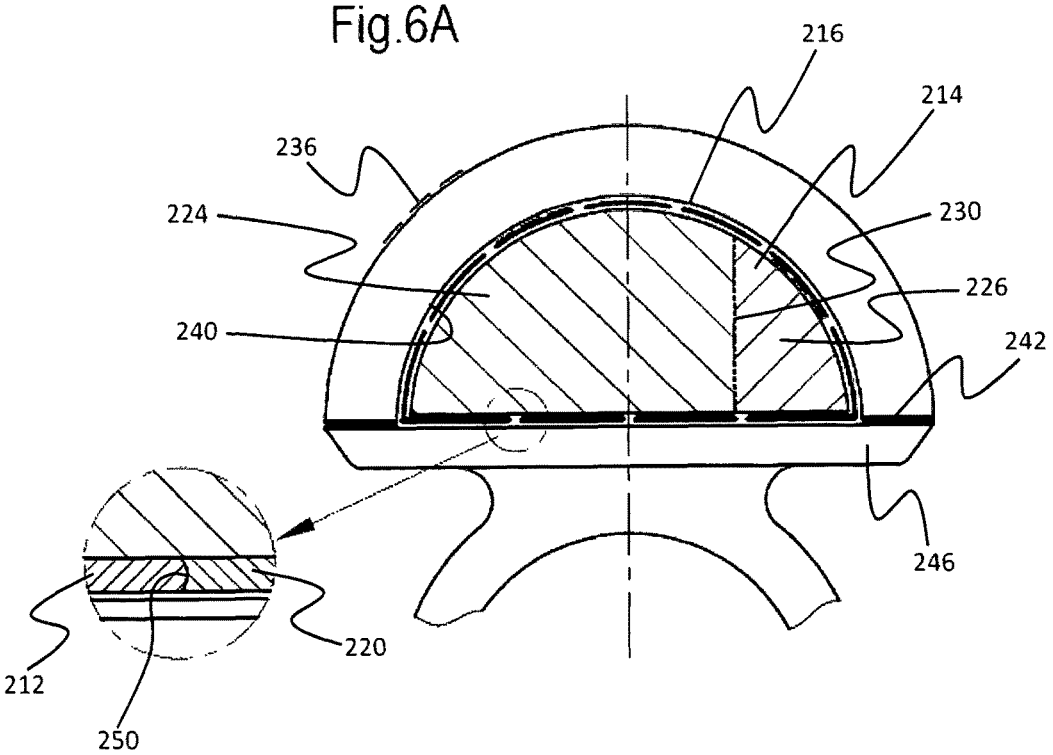
FIG. 6B is a cross-section view of the sixth embodiment.

Referring now to FIGS. 6A and 6B, a ring 210 with a transparent dome 212 is made of glass, crystal, or precious stone, contains another dome 214 that is also transparent. The mass of this dome 214 is unbalanced, and has a surface treatment 216 that repels one of the fluids 220, 222 in which it is immersed, and attracts the other. Its unbalanced mass will cause it to move inside its housing, causing the fluids 220, 222 to move. The fluids 220, 222 are chosen so as to produce, by not mixing, shapes and optical effects similar to the optical effect of drops of gasoline floating on water. A portion such as one-third of the inside portion 224 of the dome 214 is made of the same material as the dome 212 or at least a material with the same appearance. The remaining portion of the inside portion 226 of the dome 224 has the same appearance as the dome 212, but with a substantially higher density than the inside portion 226. A fusion bonding area 230 is disposed between inside portions 224 and 226. One of the fluids 220, 222 is colored. The coating 216 repels one of the fluids 220, 222 which has an affinity to the other fluid. One fluid 220, 224 has a different color than the other fluid and is immiscible therewith. An external coating 236 of the dome 212 is provided to optimize the dome'sappearance. A coating 240 is repellent to the fluids 220, 224. An impermeable (watertight) bonding 242 of the dome 212 is attained with the base 246 of the ring 210. The base 246 of the ring 210, and in the enlarged view, a glass membrane 250 (a construct which absorbs the expansion of the fluids) is provided.

Referring now to FIGS. 7A through 7D, another embodiment of the invention is a ring 260 embellished with precious stones 262 which has a panel 264 having a network of channels 267 filled with animated fluids. The animation is facilitated by repellent surface treatments allowing the fluids contained in the channels 266 to move more easily. A ball magnet 270 is optionally disposed in a cavity 272 below the channels 266 to cause correspondingly ferromagnetic elements 274 to move within the channels.

Figure 7A:
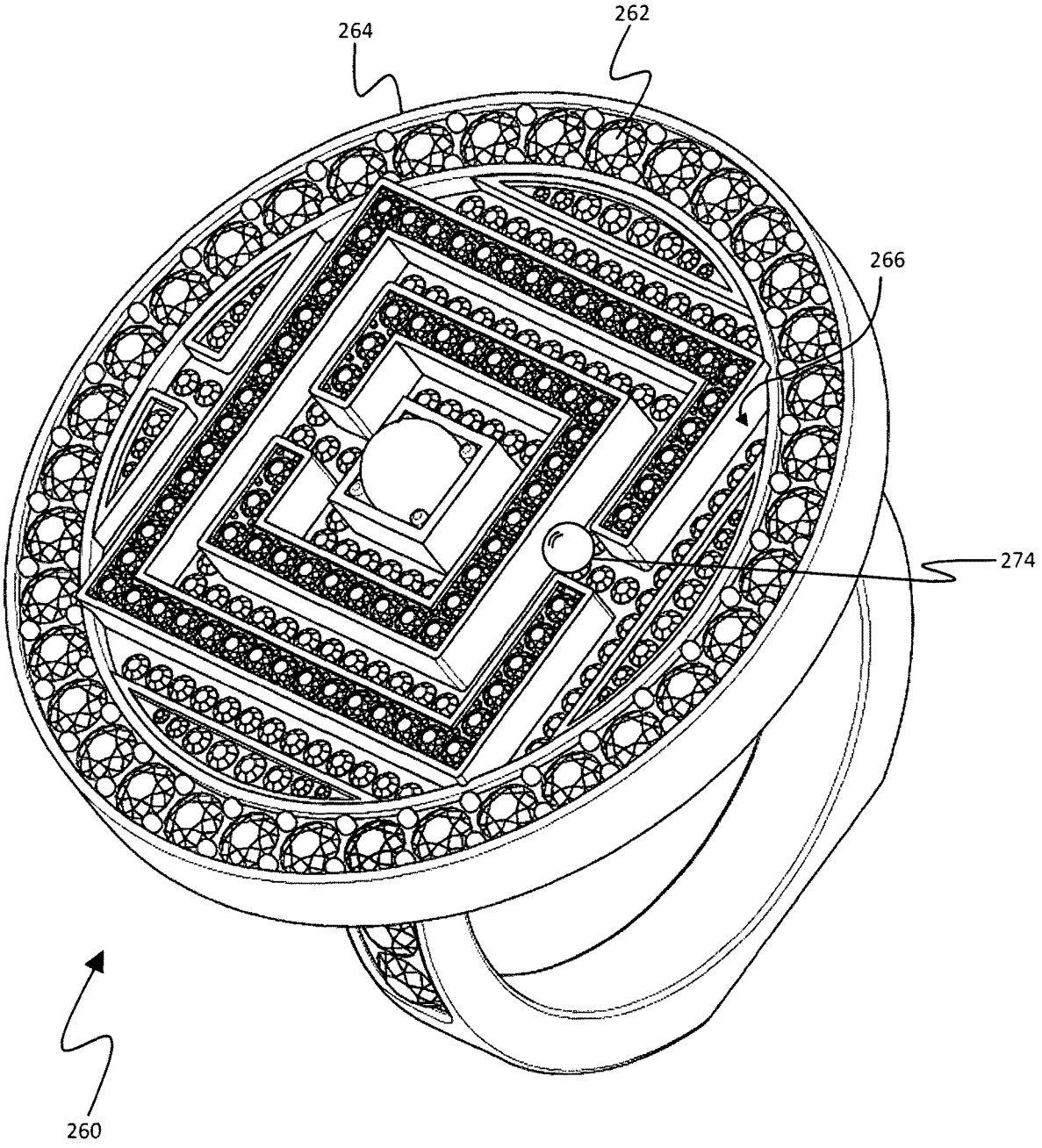
FIG. 7A is a perspective view of the seventh embodiment.
Figure 7B:
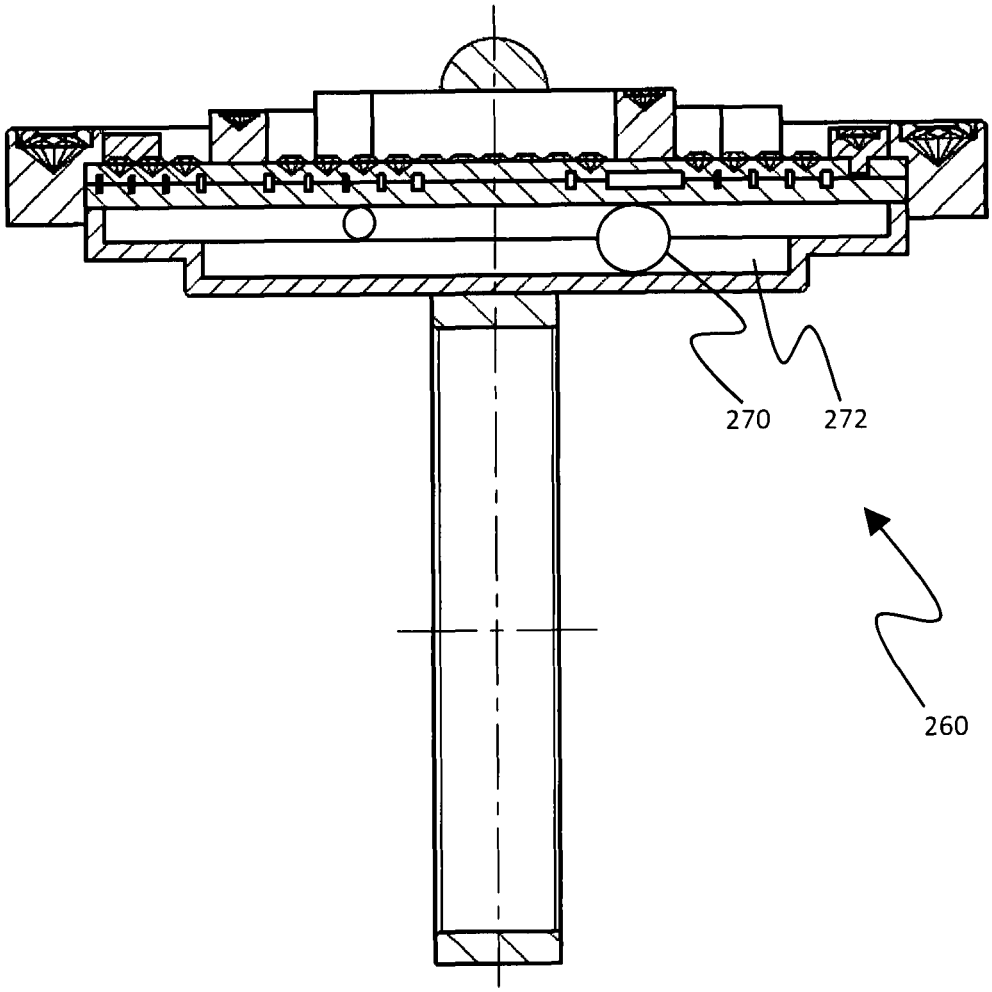
FIG. 7B is a cross-section side view of the seventh embodiment.
Figure 7C:
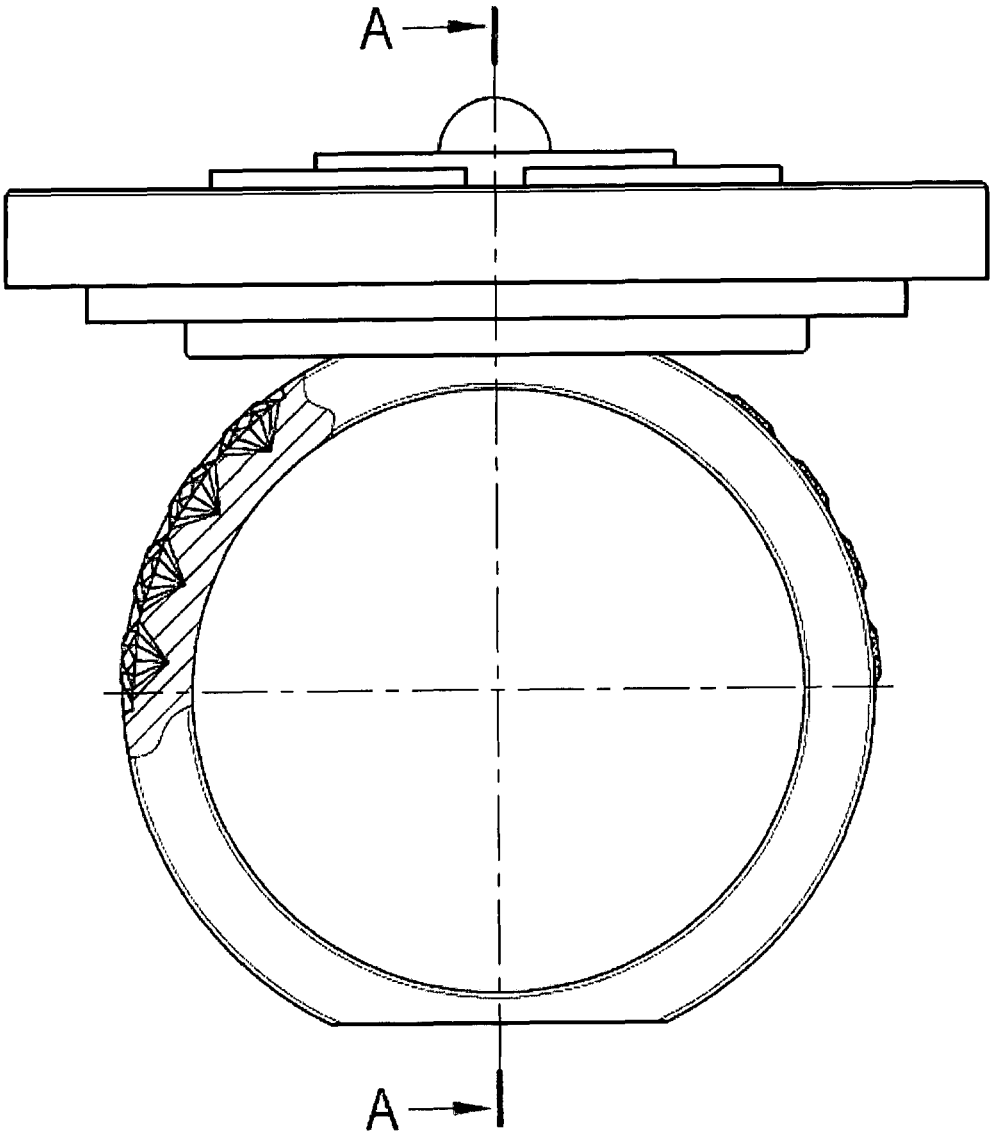
FIG. 7C is a cross-section frontal view of the seventh embodiment.
Figure 7D:
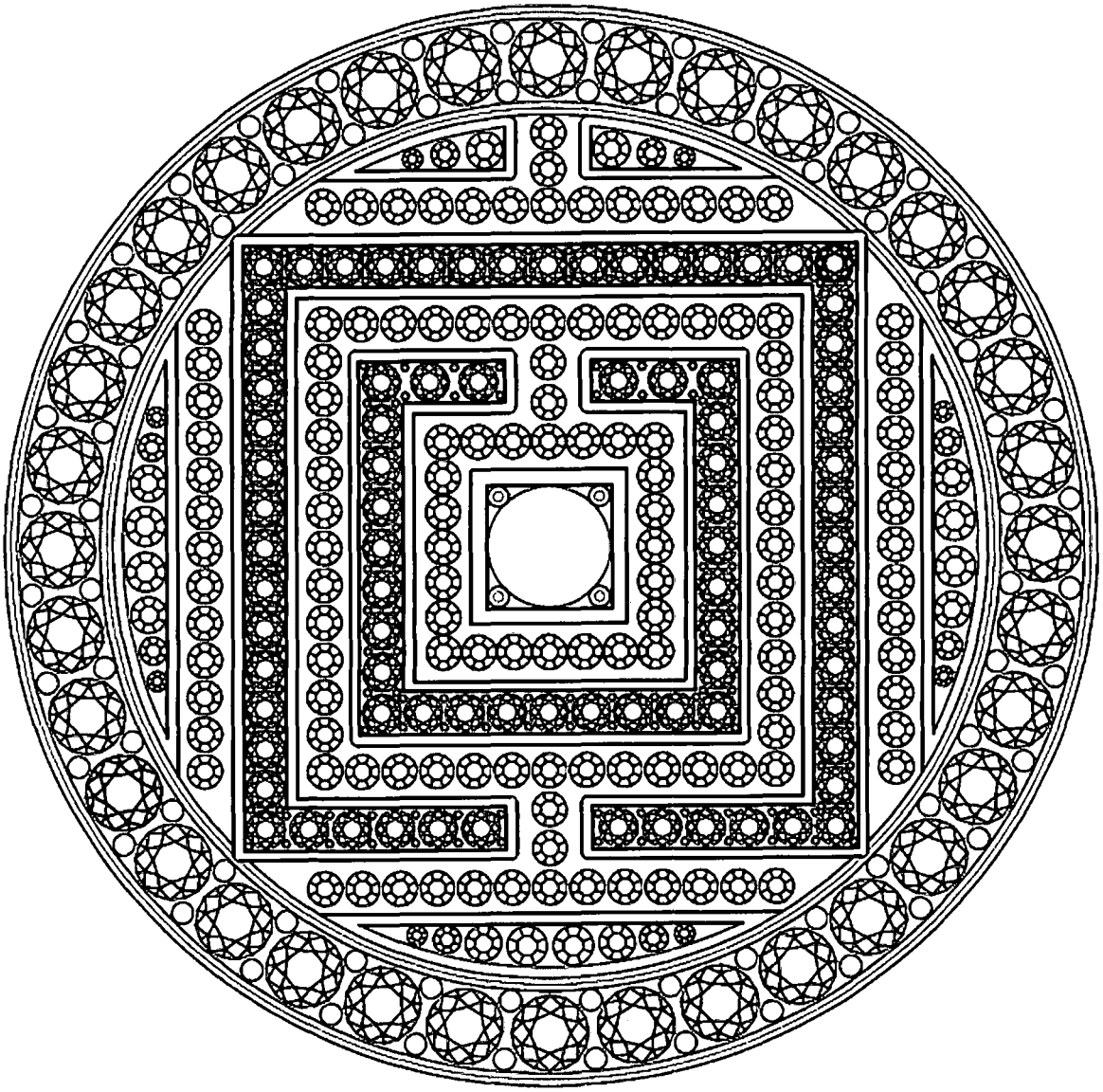
FIG. 7D is a top view of the seventh embodiment.
Figure 7E:
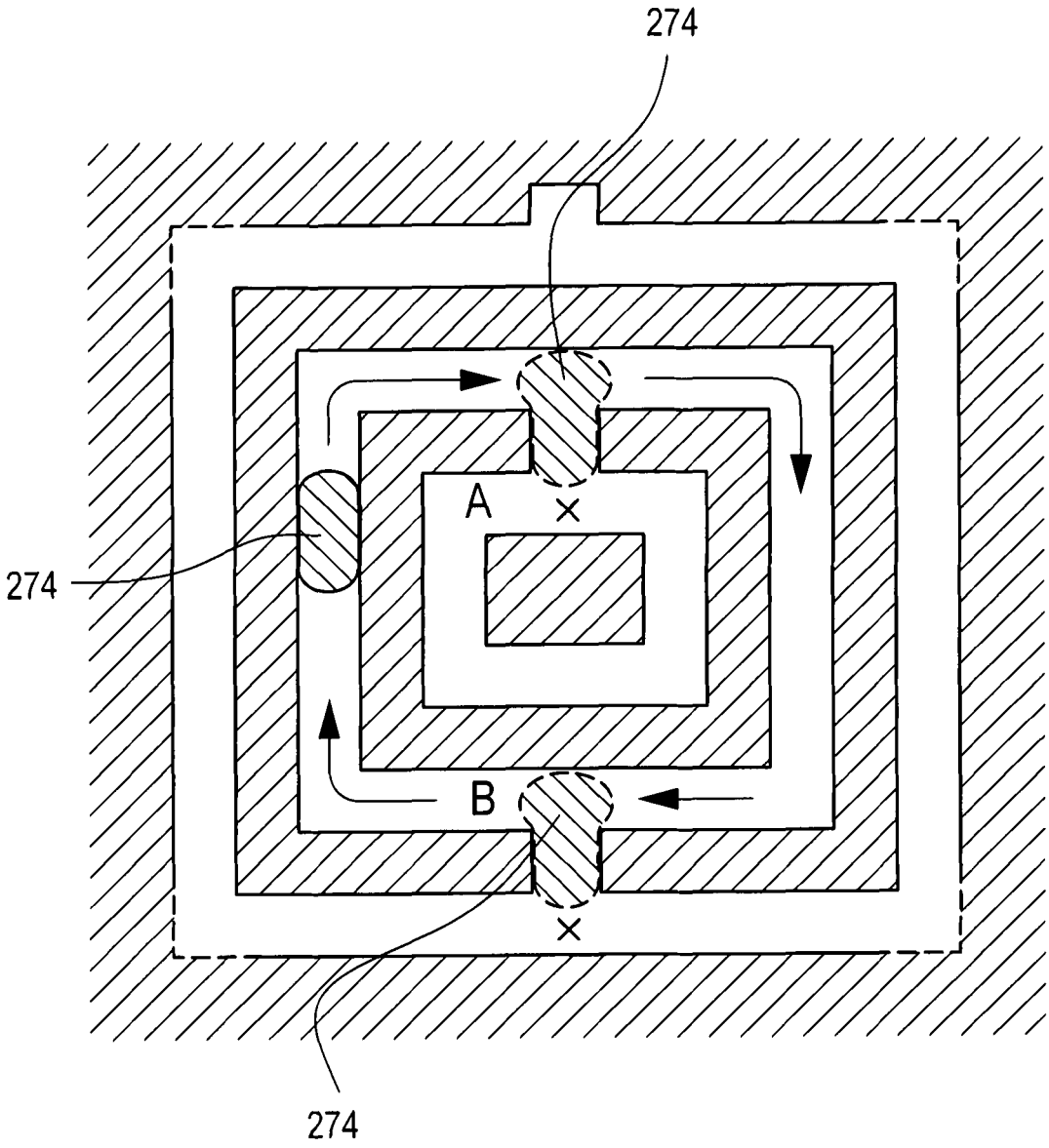
FIG. 7E is a schematic view of the seventh embodiment in operation.

Referring now to FIG. 7E, the ring 260 is shown in operation, In a configuration which is to be avoided, caused by the disposition of the network of channels 266. Assuming in this alternative embodiment that the material 274 need not ferrofluids, but can merely be a liquid 274 in the channel together with a gas (and in which there is no need for magnets 270, 270' in the recesses 272 and/or 273), it is apparent in this configuration that the upper liquid 274 is blocked against movement into the inner channel because of the gas pocket formed in the central channel when the liquid 274 moves over the relatively small passage at A. This is also the case at location B.

Figure 7F:
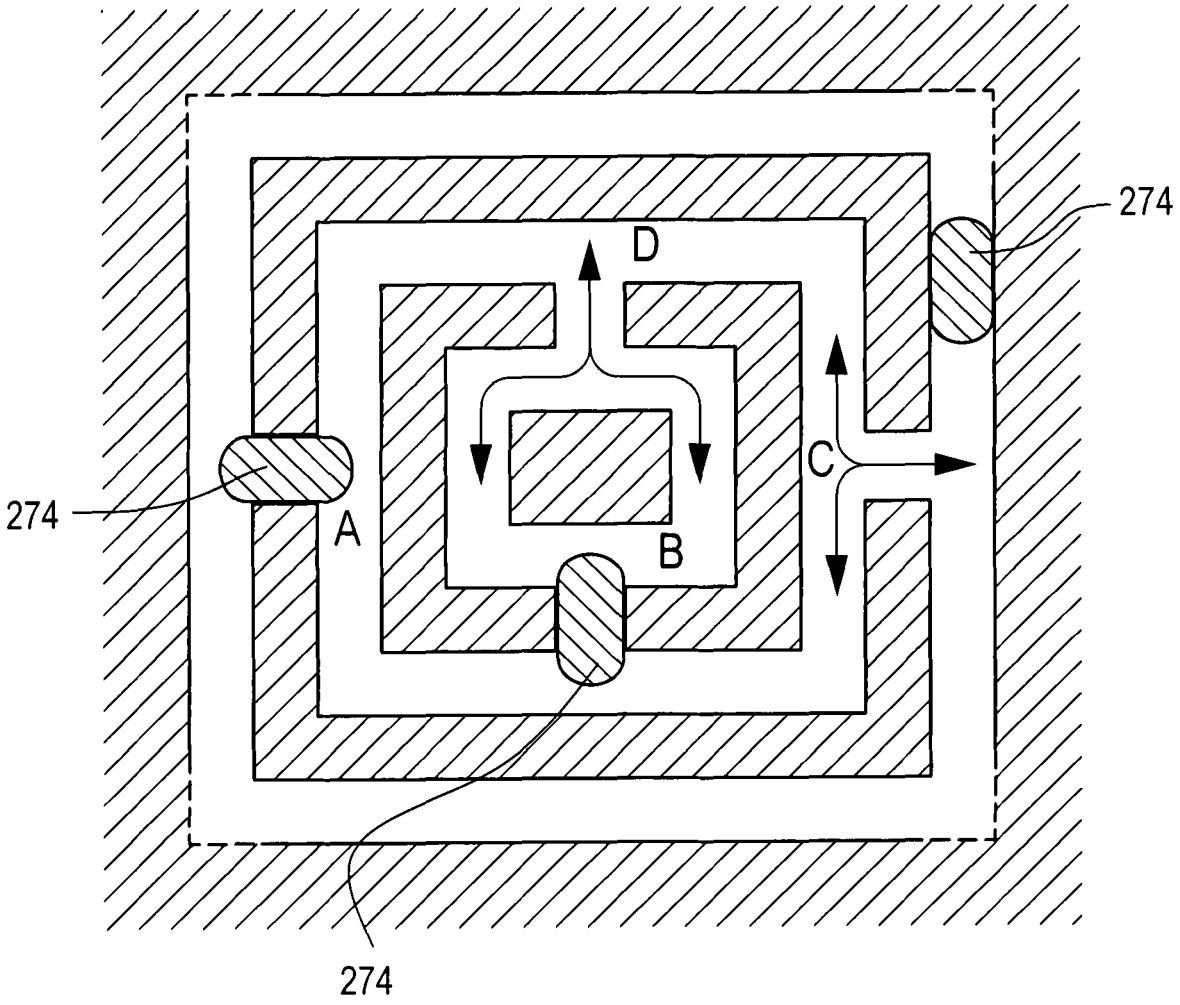
FIG. 7F is a schematic view of a variant of the seventh embodiment in operation, which allows fluid to move more freely in the channels.

Referring now to FIG. 7F, the ring 260' is shown in operation in which the network of channels avoid gas pockets, thereby allowing the material 274 to pass freely between the concentric channels. The channels constitute a maze having passageways between concentric channels, wherein at least two passageways are provided between adjacent channels. One passageway provides an entry point of a first fluid into a channel and the other allowing for displacement of a second fluid out of the channel in order to allow entry of the first fluid therein. Optionally, one of the fluids is a gas. In this way, the material 274 in the channels are free to circulate through the passage in the right side of the figure or into the central channel at the lower portion of the figure.

Figure 7G:
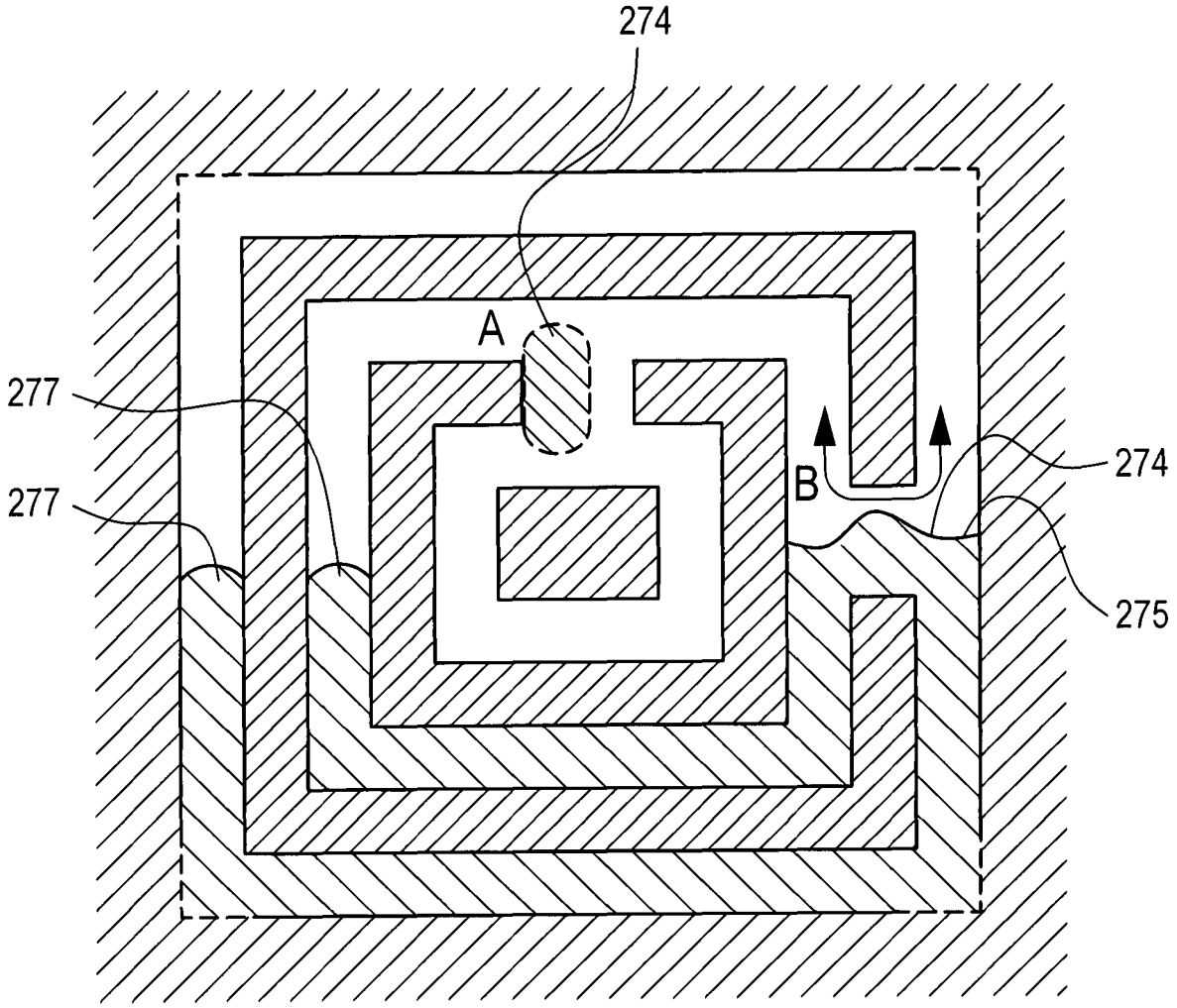
FIG. 7G is a schematic view of a variant of the seventh embodiment in operation.

Referring now to FIG. 7G, the ring 260' is shown in operation in which passages are formed large enough to avoid capillary action thus permitting free flow of fluids in the channels. Note the free liquid surface 275 as compared to the menisci 277 formed in narrower channels on the left of the figure. In addition, the passageway may be chosen to be larger than the size of the material 274. For this effect it is desirable that the surfaces of the channels be treated to have a surface tension such that considering the mass and weight of liquid or liquids selected for introduction into the fluid reservoir, and consequently the gravitational force on such chosen liquid or liquids, the gravitational force on the chosen liquid or liquids readily overcomes any attraction force to the surface in the reservoir, thus permitting ease of circulation of the chosen fluid or fluids within the reservoir. On the other hand, the surfaces of the channels may be treated to have a low surface tension at least in some areas, depending on the visual effect sought. It is important to note that even for the ring 260, in which there are pockets and potential blockages due to the concentric channels not having two passageways therebetween, a selection of surface treatment of the surfaces of the channels, the surface tension of the material 274, whether higher or lower, and the geometry, including relative size of the passageway exists that enables the material 274 to readily pass between concentric passageways.

It should be appreciated that this variant provides a pleasing aesthetic effect without the use of magnets. Gravity alone is a sufficient motive force.

Figure 8A:
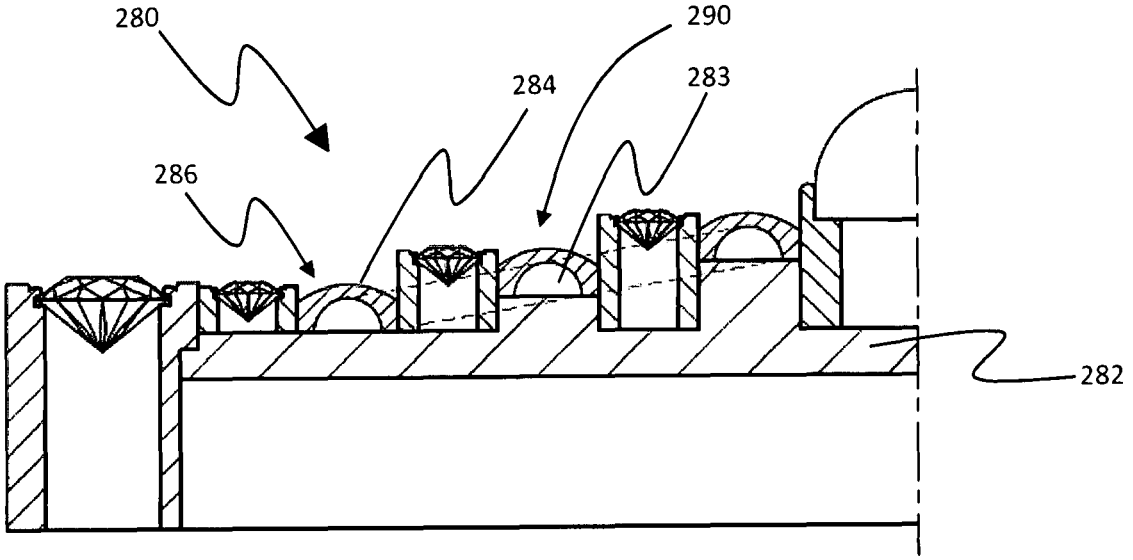
FIG. 8A is a cross sectional view of an eighth embodiment of the invention.

Referring now to FIG. 8A, another embodiment 280 of the ring 260 of the invention of FIGS. 7A and 7B is described. In this second variant, the ring 280 has tiered sapphire base plate 282 in which semi-circular channels 283 (not square channels as in ring 260) are formed by bonding with a convex shaped transparent element 284 such that a "magnifying" effect if seen from above, but which optically reduce the width of the channels 283 if viewed from the side due to a parallax effect. The height of the channels 283 conforms to that of the tiers of the ring 280. The channels 283 are inclined in the passage from one tier 286 of the labyrinth to another 290.

Figure 8B:
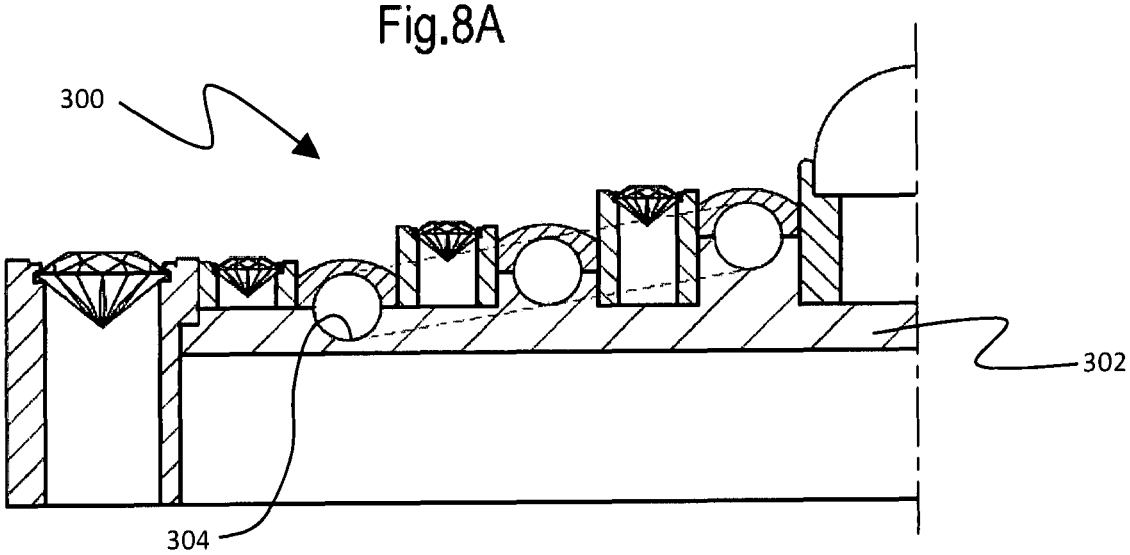
FIG. 8B is a cross sectional view of a ninth embodiment of the invention.

Referring now to FIG. 8B, in another embodiment 300, a tiered sapphire base plate 302 is provided with machined semicircular half-channels 304 in order to optimize the hydraulic resistance. The height of the channels 304 conforms to the tiers of the ring, with channels inclined in the passage from one tier of the labyrinth to another, as before.

Figure 8C:
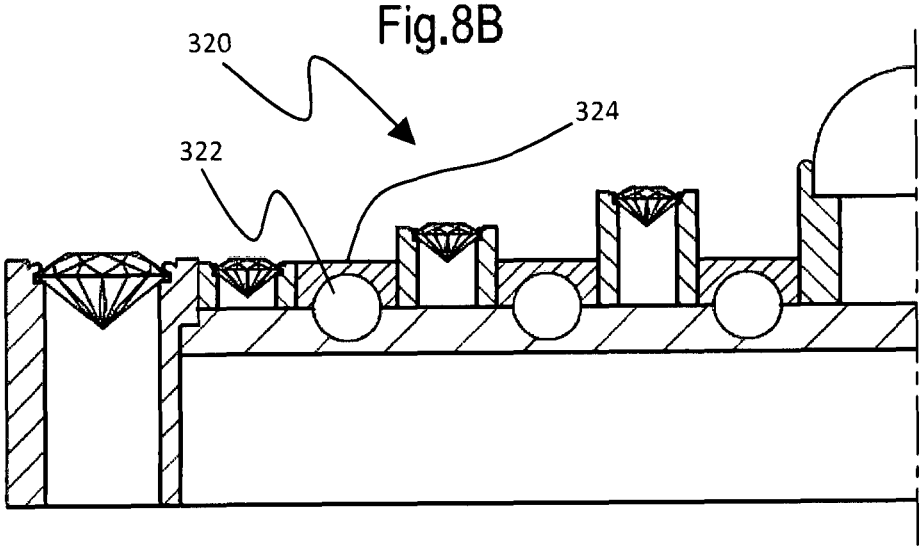
FIG. 8C is a cross sectional view of a tenth embodiment of the invention.

Referring now to FIG. 8C, in another embodiment 320, in a top view, the sapphire channels 322 are formed by bonding with a flat shape 324 (no "magnifying" effect if seen from above, and no parallax effect). The height of the channels 322 is aligned with the lowest inlaid tiers of the ring 320, and so there are no inclined channels.

Figure 8D:
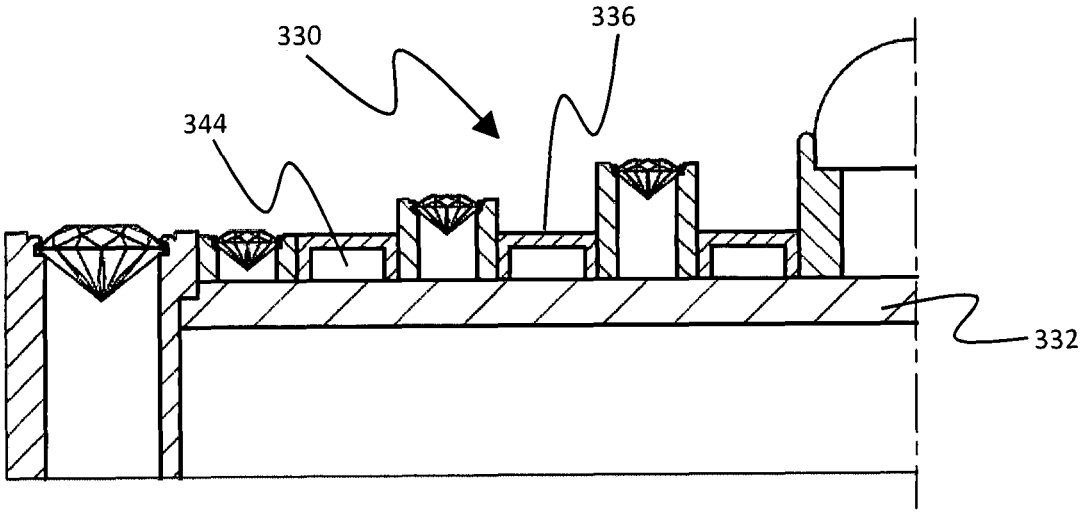
FIG. 8D is a cross sectional view of an eleventh embodiment of the invention.

Referring now to FIG. 8D, in another embodiment 330, which also has a flat sapphire base plate 332, has rectangular sapphire channels 334 formed by bonding with a flat shape 336 (therefore no "magnifying" effect if seen from above), and so machining is simplified but hydraulic resistance is not optimal. The height of the channels 334 is aligned with the lowest inlaid tiers of the ring 330, and so there areno (space) inclined channels.

Figure 8E:
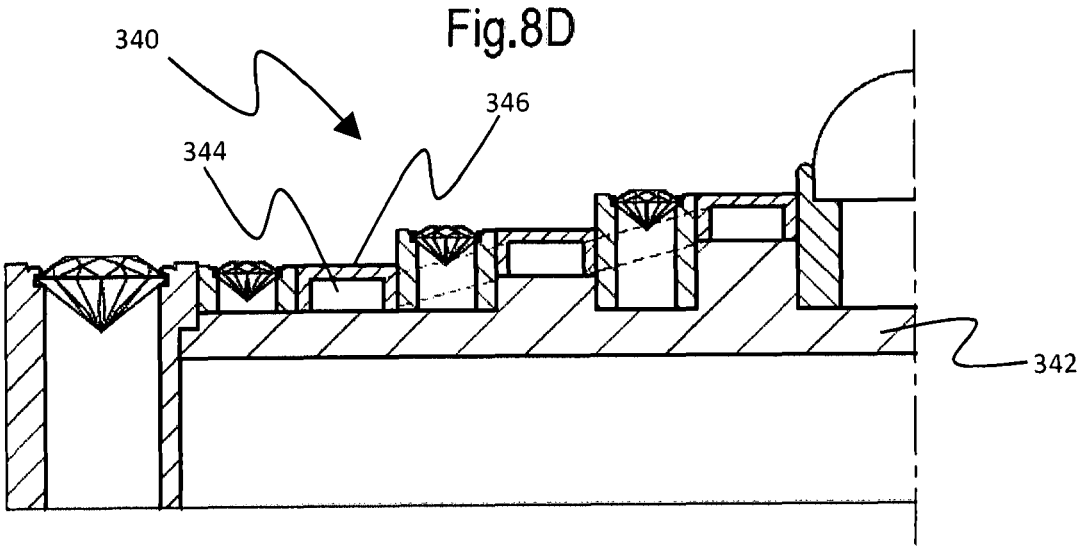
FIG. 8E is a cross sectional view of a twelfth embodiment of the invention.

Referring now to FIG. 8E, in another embodiment 340, which also has a tiered sapphire base plate 342, rectangular sapphire channels 344 are formed by bonding with a flat shape 346 (therefore no "magnifying" effect if seen from above). The height of the channels 344 conforms to the inlaid tiers of the ring 340. The channels 344 are inclined in the passage from one tier of the labyrinth to another.

Figure 8F:
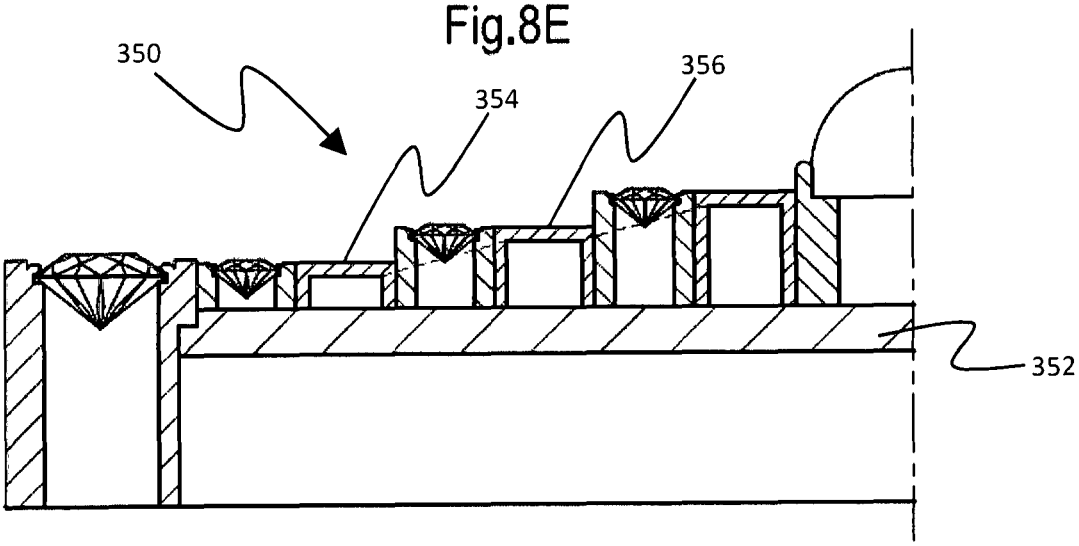
FIG. 8F is a cross sectional view of a thirteenth embodiment of the invention.

Referring now to FIG. 8F, in still another embodiment 350, which also has a flat sapphire base plate 352, rectangular sapphire channels 354 of variable height are formed by bonding with a flat shape 356 (and so no "magnifying" effect if seen from above), which results in complex machining of the top part of the channels. The height of the channels 354 conforms to the inlaid tiers of the ring 350 and so the channels are inclined in the passage from one tier of the labyrinth to another.

Figure 8G:
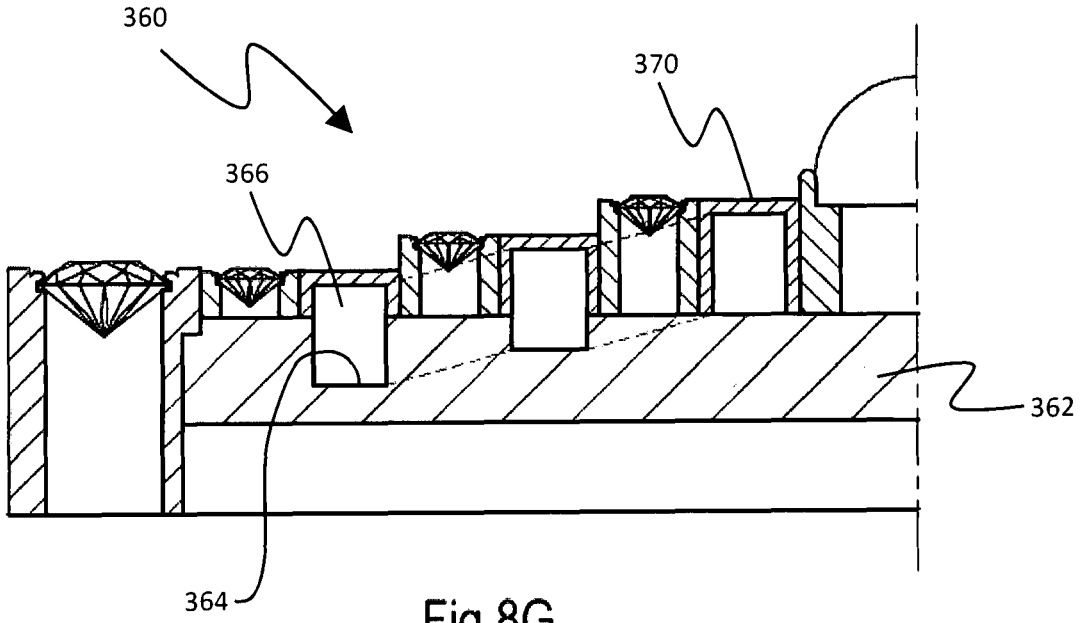
FIG. 8G is cross sectional view of a fourteenth embodiment of the invention.

Referring now to FIG. 8G, in still another embodiment 360, which also has a tiered sapphire base plate 362, involves machining of the bottoms 364 of the channels 366. Rectangular sapphire channels 366 are formed by bonding with a flat shape 370 of constant height (therefore no "magnifying" effect if seen from above). The height of the channels 366 conforms to the inlaid tiers of the ring 360 and so the channels are inclined in the passage from one tier of the labyrinth to another.

In an advantage, the invention provides an animated, wearable construct that is interesting to view and wear.

In another advantage, the invention uses effects that are new and aesthetically pleasing.

It should be appreciated that the particular implementations shown and herein described are representative of the invention and its best mode and are not intended to limit the scope of the present invention in any way.

It should be appreciated that many applications of the present invention may be formulated.

As will be appreciated by skilled artisans, the present invention may be embodied as a system, a device, or a method.

Moreover, the system contemplates the use, sale and/or distribution of any goods, services or information having similar functionality described herein.

The specification and figures should be considered in an illustrative manner, rather than a restrictive one and all modifications described herein are intended to be included within the scope of the invention claimed. Accordingly, the scope of the invention should be determined by the appended claims (as they currently exist or as later amended or added, and their legal equivalents) rather than by merely the examples described above. Steps recited in any method or process claims, unless otherwise expressly stated, may be executed in any order and are not limited to the specific order presented in any claim. Further, the elements and/or components recited in apparatus claims may be assembled or otherwise functionally configured in a variety of permutations to produce substantially the same result as the present invention. Consequently, the invention should not be interpreted as being limited to the specific configuration recited in the claims.

Benefits, other advantages and solutions mentioned herein are not to be construed as critical, required or essential features or components of any or all the claims.

As used herein, the terms "comprises", "comprising", or variations thereof, are intended to refer to a non-exclusive listing of elements, such that any apparatus, process, method, article, or composition of the invention that comprises a list of elements, that does not include only those elements recited, but may also include other elements such as those described in the instant specification. Unless otherwise explicitely stated, the use of the term "consisting" or "consisting of" or "consisting essentially of" is not intended to limit the scope of the invention to the enumerated elements named thereafter, unless otherwise indicated. Other combinations and/or modifications of the above-described elements, materials or structures used in the practice of the present invention may be varied or adapted by the skilled artisan to other designs without departing from the general principles of the invention.

The patents and articles mentioned above are hereby incorporated by reference herein, unless otherwise noted, to the extent that the same are not inconsistent with this disclosure.

Other characteristics and modes of execution of the invention are described in the appended claims.

Further, the invention should be considered as comprising all possible combinations of every feature described in the instant specification, appended claims, and/or drawing figures which may be considered new, inventive and industrially applicable.

Copyright may be owned by the Applicant(s) or their assignee and, with respect to express Licensees to third parties of the rights defined in one or more claims herein, no implied license is granted herein to use the invention as defined in the remaining claims. Further, vis-à-vis the public or third parties, no express or implied license is granted to prepare derivative works based on this patent specification, inclusive of the appendix hereto and any computer program comprised therein.

Additional features and functionality of the invention are described in the claims appended hereto. Such claims are hereby incorporated in their entirety by reference thereto in this specification and should be considered as part of the application as filed.

Multiple variations and modifications are possible in the embodiments of the invention described here. Although certain illustrative embodiments of the invention have been shown and described here, a wide range of changes, modifications, and substitutions is contemplated in the foregoing disclosure. While the above description contains many specific details, these should not be construed as limitations on the scope of the invention, but rather exemplify one or another preferred embodiment thereof. In some instances, some features of the present invention may be employed without a corresponding use of the other features. Accordingly, it is appropriate that the foregoing description be construed broadly and understood as being illustrative only, the spirit and scope of the invention being limited only by the claims which ultimately issue in this application.

What is claimed is:

1. A decorative construct adapted to be worn by a wearer, the construct providing a structure on which functional elements are integrated, the functional elements comprising:

a) at least two immediately adjacent fluid reservoirs containing objects;

b) at least two liquids disposed in said fluid reservoirs; and c) a motion generator, said motion generator configured to create motion of the fluids and at least one of the objects when the construct is moved with respect to a gravity vector.

2. The construct of claim 1, wherein the motion causes a separation between fluids of differing specific weights.

3. The construct of claim 1, wherein an attraction or repulsion force acting on the motion generator is generated by a magnetic field of the micro-magnet.

4. The construct of claim 1, wherein the motion generator is eccentric to an axis of motion such as rotation so that motion of the user moves the motion generator which in turn directly interacts with at least one of the at least two fluids in the fluid reservoir, thereby creating an animated movement of the fluids.

5. The construct of claim 1, wherein surface tension of a fluid in a fluid reservoir is induced by coatings on a surface of a fluid reservoir, such surface tension determining the form and movement of the fluid or fluids.

6. The construct of claim 1, wherein particulate is suspended in at least one of the fluids.

7. The construct of claim 1, wherein surface tension of surfaces of particulate suspended in the fluid or fluids effects an interface surface between the fluid and particulate.

8. The construct of claim 1, wherein the two fluids are immiscible.

9. The construct of claim 1, wherein at least one fluid is a liquid and the other a gas.

10. The construct of claim 1, wherein the two fluids are of different colors or refraction indexes so that one fluid is readily visually discernable from the other.

11. The construct of claim 1, wherein decorative elements are suspended in at least one fluid.

12. The construct of claim 1, wherein the reservoir is a maze and the fluids are guided within the maze by a mass.

13. The construct of claim 12, wherein the mass is the mass of a liquid enclosed in the fluid reservoir.

14. The construct of claim 12, wherein the mass is a magnet.

15. The construct of claim 1, wherein the motion generator comprises at least one magnet.

16. The construct of claim 15, wherein at least one of the at least one magnet is attached to a buoy device which causes the at least one magnet to float in the at least one fluid.

17. The construct of claim 1, wherein the motion generator comprises at least one magnet.

18. The construct of claim 17, wherein at least one of the at least one magnet is attached to a buoy device which causes the at least one magnet to float in the at least one fluid.

19. The construct of claim 1, wherein the construct is a timepiece.

20. The construct of claim 1, wherein the construct is a piece of jewelry.

21. The construct of claim 1, wherein the construct is a bracelet.

22. The construct of claim 1, wherein the construct is a necklace.

23. The construct of claim 1, wherein the construct is a decorative body piercing element.

24. The decorative construct of claim 1, wherein the at least two immediately adjacent fluid reservoirs are nested.

25. The construct of claim 24, wherein at least one of the objects is a micro-magnet.

26. A decorative construct adapted to be worn by a wearer, the construct providing a structure on which functional elements are integrated, the functional elements comprising:

a) at least two immediately adjacent fluid reservoirs containing objects;

b) at least two fluids-disposed in said fluid reservoirs; and c) a motion generator, said motion generator configured to create motion of the fluids and at least one of the objects when the construct is moved with respect to a gravity vector, wherein at least one fluid is liquid mercury.

* * * * *